US008966775B2

(12) United States Patent
Regan et al.

(10) Patent No.: US 8,966,775 B2
(45) Date of Patent: Mar. 3, 2015

(54) DIGITAL BITE LINE CREATION FOR SHOE ASSEMBLY

(71) Applicant: NIKE, Inc., Beaverton, OR (US)

(72) Inventors: Patrick Conall Regan, Taichung (TW); Chih-Chi Chang, Yunlin County (TW); Ming-Feng Jean, Yunlin County (TW)

(73) Assignee: NIKE, Inc., Beaverton, OR (US)

( * ) Notice: Subject to any disclaimer, the term of this patent is extended or adjusted under 35 U.S.C. 154(b) by 318 days.

(21) Appl. No.: 13/647,511

(22) Filed: Oct. 9, 2012

(65) Prior Publication Data

US 2014/0096403 A1 Apr. 10, 2014

(51) Int. Cl.

| | |
|---|---|
| ***A43D 1/08*** | (2006.01) |
| ***A43D 25/18*** | (2006.01) |
| ***G01B 11/24*** | (2006.01) |

(52) U.S. Cl.

USPC ..... 33/6; 33/3 R

(58) Field of Classification Search

CPC ..... A43D 1/04; A43D 1/08; A43D 25/18; A43D 2200/60; G01B 5/00; G01B 5/20; G01B 7/00; G01B 7/28; G01B 11/00; G01B 11/24

USPC ..... 33/3 R, 6; 12/17.2, 142 R, 142 T; 112/44, 112/46, 52; 702/167, 168

See application file for complete search history.

(56) References Cited

U.S. PATENT DOCUMENTS

| | | | | |
|---|---|---|---|---|
| 4,541,062 | A * | 9/1985 | Kada et al. | 700/247 |
| 4,706,316 | A | 11/1987 | Tanzi | |
| 7,809,523 | B2 * | 10/2010 | Hunter et al. | 702/168 |
| 7,918,036 | B2 * | 4/2011 | Ishikawa | 33/559 |
| 2003/0231793 | A1 | 12/2003 | Crampton | |
| 2011/0232008 | A1 | 9/2011 | Crisp | |
| 2013/0131854 | A1 * | 5/2013 | Regan et al. | 700/114 |
| 2013/0132038 | A1 | 5/2013 | Regan et al. | |
| 2014/0081441 | A1 * | 3/2014 | Regan et al. | 700/98 |

FOREIGN PATENT DOCUMENTS

| | | | | |
|---|---|---|---|---|
| DE | 3804715 | A1 * | 8/1988 | A43D 8/02 |
| DE | 4211634 | A1 * | 10/1993 | A43D 119/00 |
| EP | 0422946 | | 6/1996 | |
| FR | 2690864 | A1 * | 11/1993 | B23Q 3/06 |
| WO | WO 9955186 | A1 * | 11/1999 | A43D 1/04 |

OTHER PUBLICATIONS

Notification of Transmittal of the International Search Report and the Written Opinion of the International Searching Authority, or the Declaration in PCT/US13/63886, 30 pages.

* cited by examiner

*Primary Examiner* — R. A. Smith

(74) *Attorney, Agent, or Firm* — Shook, Hardy & Bacon L.L.P.

(57) ABSTRACT

A system and method may simultaneously apply a limited visibility bite line to a temporarily assembled shoe upper and shoe sole while also generating a digital bite line. The digital bite line may be used to generate a tool path for the application of adhesives to the shoe upper and/or to the shoe sole assembly to permanently assemble the shoe. The limited visibility bite line may comprise a mark or other indicia observable only under specific viewing conditions and/or only for a limited amount of time or until removal. The limited visibility bite line may be used for quality control check purposes to verify, for example, the proper application of adhesives or the proper assembly of the shoe. The limited visibility bite line may be unobservable to the ultimate purchaser and/or wearer of the shoe.

20 Claims, 4 Drawing Sheets

DIGITAL BITE LINE CREATION FOR SHOE ASSEMBLY

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

The present invention relates to a system and method for generating bite lines for the assembly of shoes. More particularly, the present invention relates to a system and method for creating a digital bite line for use in applying adhesives as part of the assembly of a shoe upper to a shoe sole assembly and to creating limited visibility bite lines for use in quality control checking during the manufacturing of shoes.

BACKGROUND OF THE INVENTION

Shoes may be made by combining components, such as uppers and soles, which may themselves be made of sub-components. Various techniques, such as stitching and/or applying adhesives may be used to combine the components and/or sub-components of a shoe into a finished product. Whatever technique is used to join components and/or sub-components during the assembly of a shoe, those components and/or sub-components must be combined at the proper locations and in proper alignment in order for the assembled shoe to function properly.

BRIEF SUMMARY OF THE INVENTION

The present invention generally relates to shoes, especially athletic shoes, typically comprise an upper portion that at least partially encloses the foot of the wearer and a sole portion that protects contacts the ground, floor or other surface upon which the wearer will stand, walk or run. Uppers are often made of leather, fabric, flexible sheets, or other types of material that may be curved and shaped in three dimensions and are sufficiently pliable to receive human feet while providing a desired amount of durability, support, and protection to the wearer's foot. Soles often comprise at least two components, an outsole and a midsole. An outsole, if used, contacts the ground or other surface and, therefore, may provide any desired traction properties and sufficient resilience to last the intended lifespan of the shoe without degrading or wearing through due to friction during walking, running, etc. A midsole, if used, may provide cushioning to the wearer's foot, which may be particularly desirable for activities, such as many sports, that often involve a wearer's foot impacting the ground, floor or other surface repeatedly and/or with great force. Even many non-athletes prefer to wear shoes that provide considerable cushioning from the combined midsole and outsole assemblies similar to those found in many sports shoes, and may likewise prefer the support and/or protection often provided by a sports shoe upper.

As a result of the desires of protection and support from an upper, cushioning from a midsole, and traction and durability of an outsole, a given shoe may utilize diverse materials and structural designs for these different components of a shoe. Nevertheless, these components must be ultimately integrated to form a wearable shoe that is both functional and, ideally, attractive. One approach is to use an adhesive or adhesives to affix an outsole and a midsole together and then to use different or similar adhesives to affix the sole assembly to the upper. When using such an approach, however, care must be taken to provide sufficient adhesive coverage between the sole assembly and the upper in order to create an acceptably strong bond, but care must also be taken to avoid over application of adhesives to other regions of a shoe, such as the portions of the upper immediately above the midsole, as such an over application of adhesives can be unsightly at best and wasteful or detrimental to the performance of the shoe in some circumstances. While meticulous and time consuming hand work coupled with a high rejection rate during quality control processes may achieve shoes with uppers and sole assemblies well adhered to one another without over application of adhesives, such an approach may be costly and wasteful.

BRIEF DESCRIPTION OF THE SEVERAL VIEWS OF THE DRAWING

The present invention is described in detail below with reference to the attached drawing figures, wherein the drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION OF THE INVENTION

Figure 1:
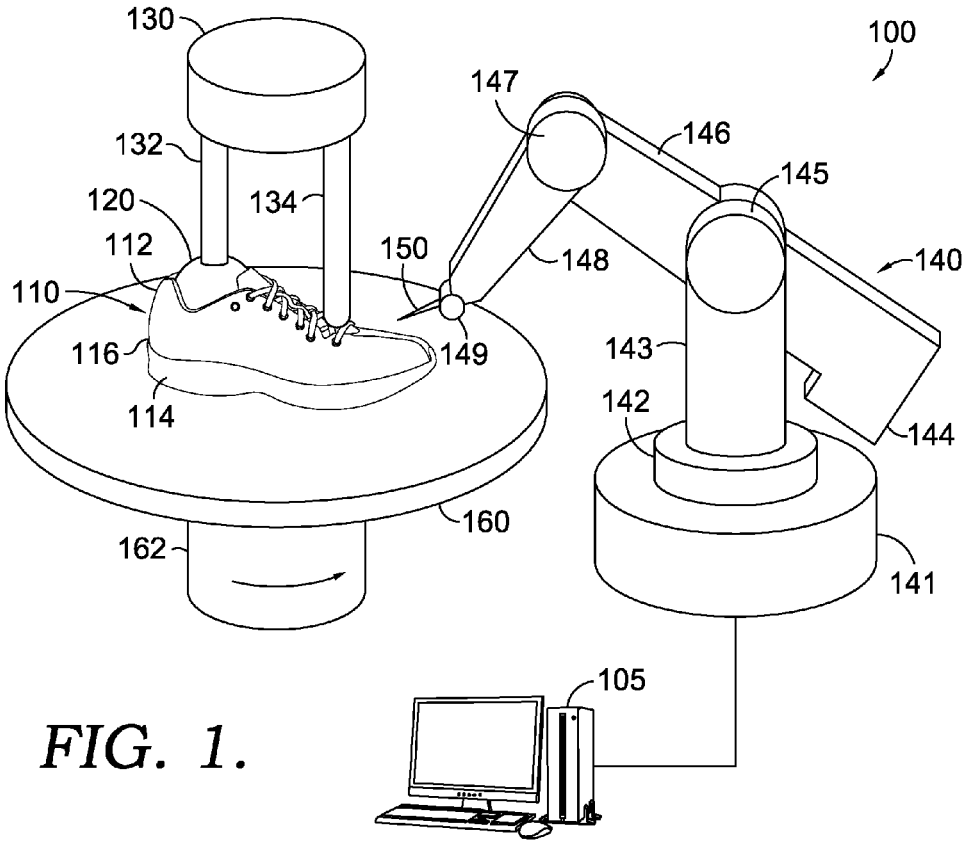
FIG. 1 illustrates a perspective view of an example system for generating a bite line on a shoe upper in accordance with the present invention.

Referring now to FIG. 1, a bite line creation system 100 may comprise and arm assembly 140 terminating with a stylus 150 and a turntable assembly 160 that receives a partially assembled shoe 110. Arm assembly 140 may comprise, for example, an apparatus such as is sometimes used to create digital representations of physical objects by converting the position of a stylus, such as stylus 150, into x,y,z coordinates or an equivalent coordinate system (such as polar coordinates). For example, arm assembly 140 may be operably connected to a computer 105 such that sensors in arm assembly 140 may transmit measurements describing the position of stylus 150 to computer 105 to permit a file representing the position of stylus 150 in a three-dimensional space over a period of time. While the example arm assembly 140 illustrated in FIG. 1 is for illustrative purposes only, arm assembly 140 may comprise a base 141 having sufficient mass to provide stability for the arm assembly 140. A collar 142 may secure a pillar 143 to base 141. A hinged joint 145 may rotatably join a first arm 146 to pillar 143. First arm 146 may terminate with a counterweight 144 at the end of first arm 146 opposite from stylus 150. Opposite of the counterweight 144, first arm 146 may be rotatably joined to a second arm 148 by a second hinge joint 147. Second arm 148 may terminate opposite second hinge joint 147 with a stylus receiving assembly 149. Stylus receiving assembly 149 may receive and firmly retain stylus 150. Stylus receiving assembly 149 may also comprise a hinged joint to permit stylus 150 to rotate relative to second arm 148. Sensors may be provided in first hinge joint 145, second hinge joint 147, stylus retainer assembly 149, and/or collar 142. Any sensors so provided may communicate with computer 105. In this fashion, a plurality of sensor readings of angles of rotation coupled with known dimensions of the various components may be translated into a digital file representing the position of the tip of stylus 150 in space during the period of time in which data is being collected. Position data may be collected and/or recorded at predetermined time intervals. The accuracy of such digital files may be enhanced by performing calibrations that involve positioning stylus 150 in one or more known and/or well defined locations relative to other components of arm assembly 140.

Still referring to FIG. 1, a partially assembled shoe 110 may be present to receive a bite line for subsequent use in the assembly process. Shoe 110 may comprise an upper portion 112 pressed against a sole assembly 114. Upper assembly 112 may receive a shoe last 120 to provide sufficient structural support to permit shoe upper 112 to be pressed into sole assembly 114 to temporarily form a junction line 116 where sole assembly 114 terminates on upper assembly 112. A pre-determined amount of pressure may be applied to temporarily press lasted upper 112 against sole assembly 114 using press 130. Press 130 may have a first member 132 that may engage shoe last 120 and a second member 134 that engages the top of lasted shoe upper 112. A turntable 160 may provide support for the partially assembled shoe 110 when pressure is applied by press 130. The force generated by press 130, the number of members extending from press 130, the type and size of last 120 used, and the like may vary for different types, varieties, and sizes of shoes. Turntable 160 may rotate about a pillar 162 or other axis at a predetermined or known rate. Turntable 160 may be rotated by a motorized operation or by hand, foot, or other power supplied by a human operator. The rate of rotation may be mechanically or electronically controlled and/or measured. By either controlling or measuring the rate of rotation, the turntable 160 and partially assembled shoe 110 may be rotated at a known rate. Press 130, first member 132, second member 134, last 120, and/or any additional members may rotate in concert with turntable 160, thereby permitting partially assembled shoe 110 to rotate as well.

Figure 2:
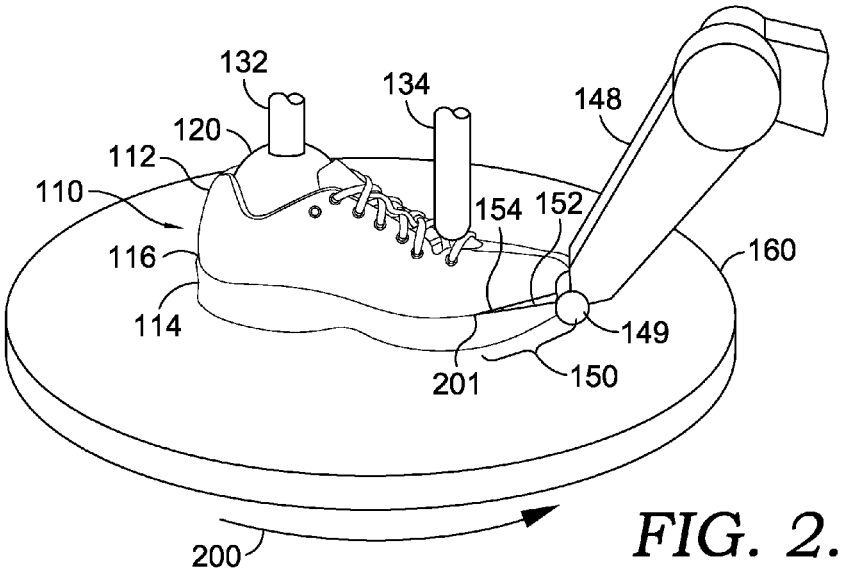
FIG. 2 illustrates a perspective view of the example system for generating a bite line on a shoe upper in accordance with the present invention while contacting a partially assembled shoe.

Referring now to FIG. 2, the exemplary system 100 of FIG. 1 is shown in greater detail. In particular, FIG. 2 illustrates stylus 150 engaged with junction line 116 of partially assembled shoe 110. As illustrated more clearly in FIG. 2, stylus 150 may comprise a stylus base 152 that connects stylus assembly 149 and a stylus tip 154 that terminates stylus 150. In the present example, stylus 150 may terminate in a marking tip 201. Marking tip 201 may create line, indicia, were other mark when contacting the shoe upper 112. Marking tip 201 may comprise, for example, an auto vanishing pen. The type of marking tip 201 used in accordance with the present invention may vary based upon the materials, color, and/or subsequent processing steps for shoe 110 and shoe upper 112. Marking tip 201 may, for example, comprise a limited visibility marking tip that create marks of erasable ink, graphite, dyes, or the like. A limited visibility marking tip 201 may generate a line on upper 112 that can be removed during subsequent processing to eliminate any unsightly marks that might be undesirable in a finished shoe. Alternatively, a limited visibility marking tip 201 may mark upper 112 with a material, such as an ink or a dye, that is visible only during certain viewing conditions, such as exposure to particular wavelengths of light such as ultraviolet, or that is visible for only a relatively short period of time after application, such as a few minutes, hours, or days.

Marking tip 201 of stylus 150 may be engaged at junction line 116 where sole assembly 114 meets lasted shoe upper 112 while turntable assembly 160 is rotated at a predetermined rate indicated by arrow 200. Data describing the position of stylus 150 may be collected and used to create a digital bite line corresponding to the junction line 116. The digital bite line thus created may be used in subsequent shoe assembly operations, such as for generating tool paths for the application of adhesives to permanently affix shoe upper 112 to sole assembly 114. Such tool paths may be utilized to prevent adhesive overspray from extending beyond the junction line 116 and on to portions of upper 112 that will not be covered by sole assembly 114 after assembly and similarly to prevent overspray from extending beyond the junction line 116 and onto portions of sole assembly 114 that will not be covered by shoe upper 112 after assembly. A limited visibility bite line generated by marking tip 201 may be utilized for quality control purposes during adhesive application and/or after assembly of the shoe upper 112 to the shoe sole assembly 114. Such a limited visibility bite line may be visible to a human or to an optical recognition system performing control evaluation to detect adhesive overspray and/or a misalignment of shoe upper 112 and sole assembly 114 in final assembly.

Stylus 150 may be engaged at junction line 116 by an operator or by automated processes and equipment. An operator who engages stylus 150 to partially assembled shoe 110 at junction line 116 may also activate the rotation of turntable 160 and initiate the collection of data by arm assembly 140 and/or computer 105, although these processes may be automated as well.

Figure 3:
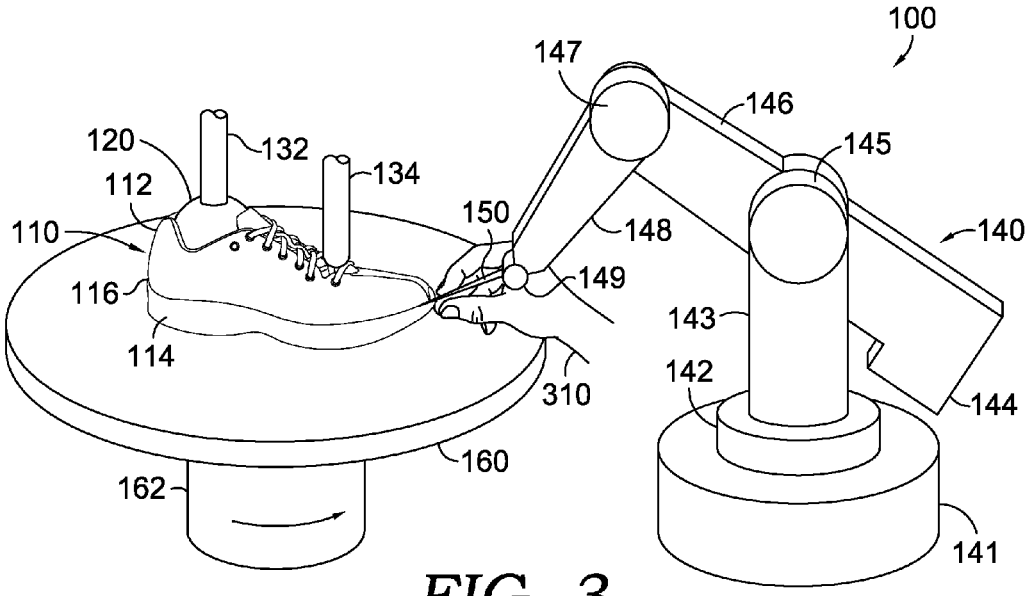
FIG. 3 illustrates a further perspective view of the example system for generating a bite line on a shoe upper in accordance with the present invention.

Referring now to FIG. 3, a further example of a bite line generation system in accordance with the present invention is illustrated. In the example shown in FIG. 3, a user may manipulate stylus 150 by hand 310 to position marking tip 201 of stylus 150 at the junction line 116 of a partially assembled shoe 110. Depending upon the type of arm assembly, computing device, and other equipment used in a system in accordance with the present invention, the manner in which a user may position or otherwise contact marketing tip 201 of stylus 150 partially assembled shoe 110 may vary.

Figure 4:
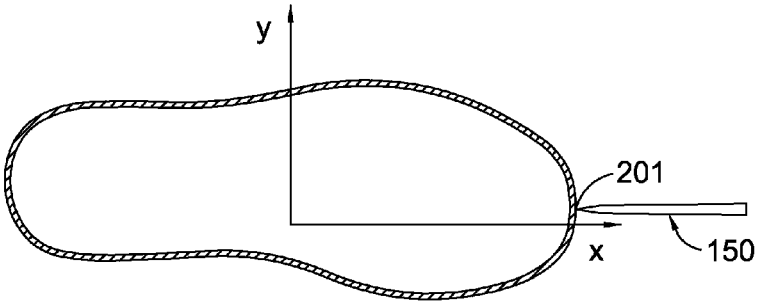
FIG. 4 illustrates a partially assembled shoe contacted by a stylus while in a first position.
Figure 5:
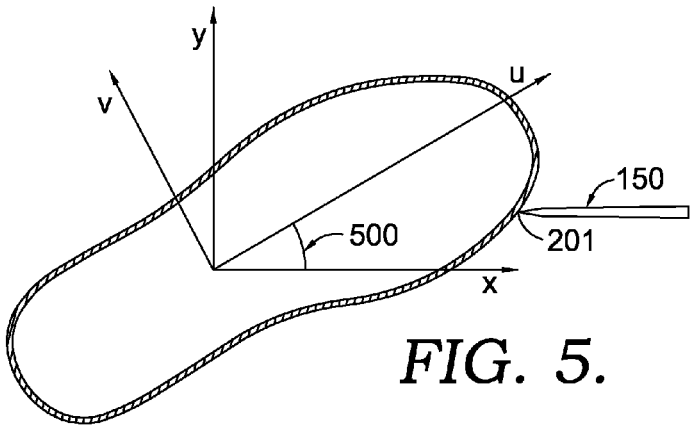
FIG. 5 illustrates a partially assembled shoe contacted by a stylus after rotation into a second position.

Referring now to FIGS. 4 and 5, example coordinate systems for use in making measurements using stylus 150 are illustrated. In FIG. 4, a cross section of a partially assembled shoe 110 is illustrated viewed from above with the cross section taken at junction line 116. As illustrated in FIG. 4, marking tip 201 of stylus 150 contacts shoe 110 at junction line 116 at a first point having coordinates in an x-y plane, although points may also have a location along a z axis that is not illustrated. While the example illustrated in FIG. 4 may represent the orientation of partially assembled shoe 110 at any time, for exemplary purposes the example illustrated in FIG. 4 may be referred to as occurring at a first time. Meanwhile, FIG. 5 illustrates partially assembled shoe 110 at a second time after shoe 110 has been rotated through a first angle 500. As illustrated in FIG. 5, now a rotated u-v plane may be associated with partially rotated shoe 110, while the non-rotated x-y plane may be associated with measurements made by stylus 150. Measurements made by stylus 150, in conjunction with arm assembly and appropriate software operating on a computing device, may be translated to the appropriate coordinates for their locations on partially assembled shoe 110 using angle 500, which may be known based upon the known rate of rotation of shoe 110 and the amount of time elapsed between the first time and the second time. Accordingly, trigonometric relationships may be used to create a digital bite line corresponding to the locations of stylus 150 at a plurality of times as partially assembled shoe 110 is rotated through at least one complete revolution. These plurality of locations may then be used to generate a digital bite line corresponding to the junction line formed with the shoe upper is pressed into the shoe sole assembly with a particular amount of pressure.

Figure 6:
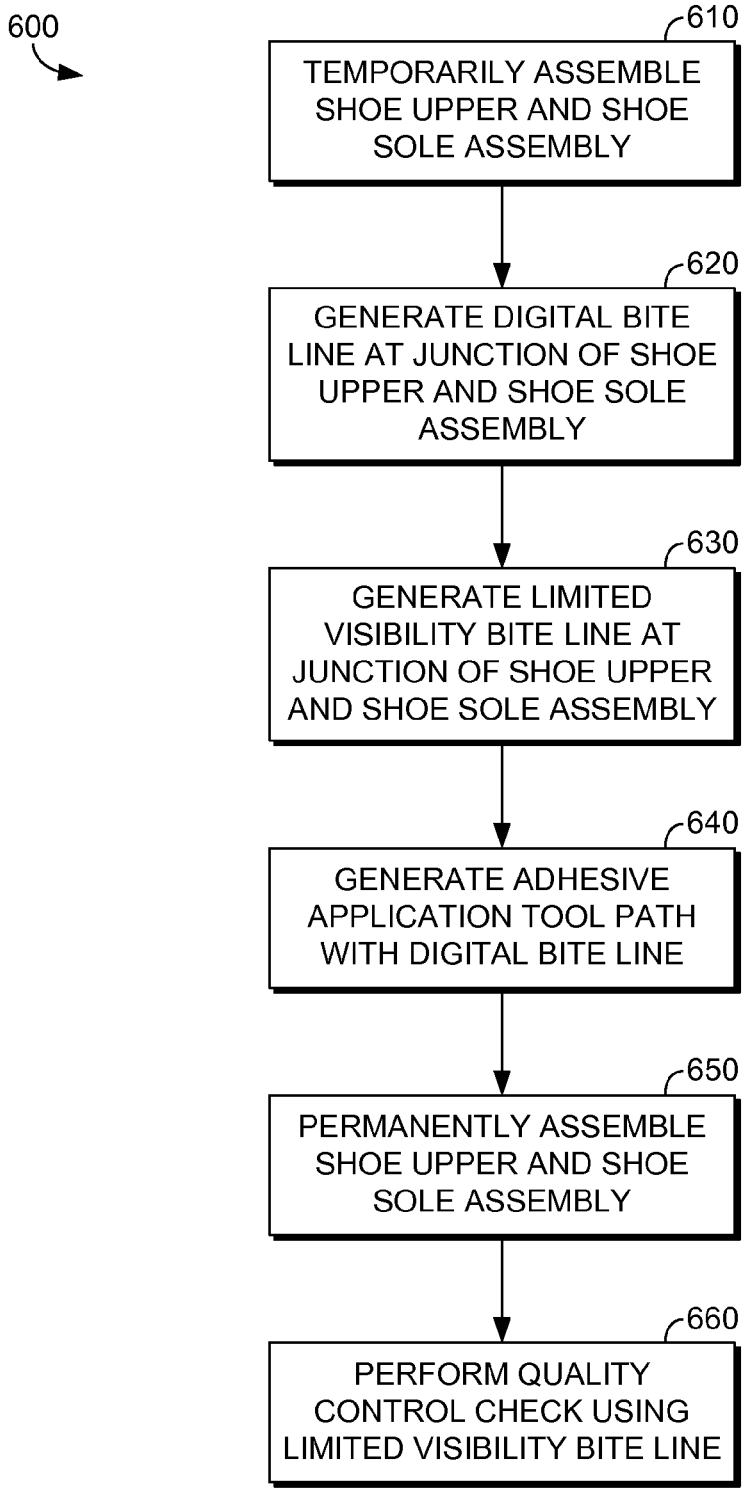
FIG. 6 illustrates an example of a method in accordance with the present invention.

Referring now to FIG. 6, a method 600 for generating bite lines on shoes is illustrated. The example illustrated by FIG. 6 represents only one example of a method 600 in accordance with the present invention. The order of steps of method 600 described may be changed, and all or part of some steps may be omitted. Method 600 they commence by temporarily assembling a shoe upper and a shoe sole assembly in step 610. Step 610 may be performed, for example, by lasting a shoe upper and administering a predetermined amount of pressure to temporarily engage the lasted shoe upper against or into a shoe sole assembly. In step 620, a digital bite line may be generated at the junction of the shoe upper and shoe sole assembly. In step 630, a limited visibility bite line may be generated at the junction of the shoe upper and shoe sole assembly. As described above, step 620 of creating a digital bite line and step 630 of generating a limited visibility bite line may be performed simultaneously using the same device. The limited visibility bite line generated in step 630 may comprise a physical mark upon the shoe upper that is observable during limited conditions, such as for only a relatively brief period of time, only under particular lighting conditions such as exposure to ultraviolet lighting, or only until erasure. In step 640 the digital bite line may be used to generate a tool path for the application of adhesives to the shoe upper and/or sole assembly for use in permanently assembling the shoe upper and shoe sole assembly. Such an application of adhesives may occur after temporarily separating the shoe upper from the shoe sole assembly. For example, step 640 may use the digital bite line generated in step 620 to guide and adhesive spray head to apply adhesive only to the portion of lasted upper bounded by the digital bite line and, hence, only to those areas ultimately covered by the sole assembly when the shoe is fully and permanently constructed. In step 660 a quality control check may be performed using the limited visibility bite line. Step 660 may be performed under conditions such that the limited visibility bite line may be observable, either to a human performing a quality control check or to a computerized optical scanning quality control system, or to some combination thereof.

Figure 7:
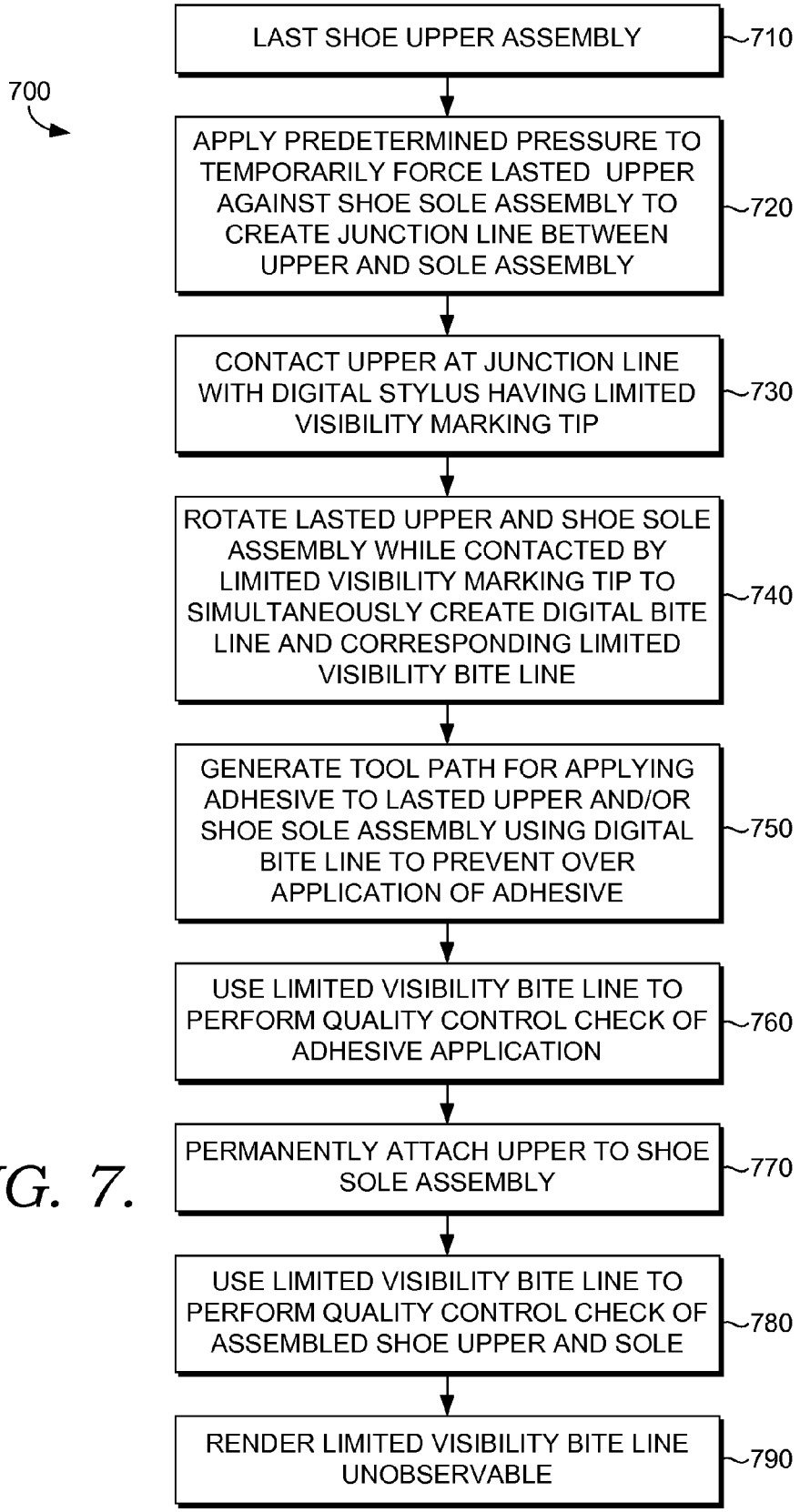
FIG. 7 illustrates an example of a further method in accordance with the present invention.

Referring now to FIG. 7, a further example of a method 700 in accordance with the present invention for simultaneously generating both a digital bite line and a limited visibility bite line is illustrated. While the steps of method 700 are described in one example order, method 700 is not limited to the order of steps described in the present example, and example steps may be omitted in whole or in part. Method 700 may commence with step 710 of lasting a shoe upper assembly. In step 720, a predetermined amount of pressure may be applied to the lasted shoe upper assembly to force the shoe upper assembly against a shoe sole assembly to temporarily assemble the lasted upper to the shoe sole assembly and to create a junction line where the shoe upper assembly meets the shoe sole assembly. In step 730, the junction line formed between the shoe upper and the shoe sole simply in step 720 may be contacted with a digital stylus having a limited visibility marking tip. After the completion of step 730, in step 740 the lasted upper and shoe sole assembly may be rotated at a known rate while being contacted by the limited visibility marking tip of the digital stylus. Step 740 may therefore simultaneously create a digital bite line and a corresponding limited visibility bite line. Step 750 may use the digital bite line created in step 740 to generate a tool path for applying adhesive to the lasted shoe upper and/or shoe sole assembly to prevent over application of adhesive beyond the bite line. A tool such as an adhesive spray head may follow the tool path generated in step 750 to apply adhesives when the lasted shoe upper and shoe sole assembly have been separated after creation of the bite lines. In step 760, the limited visibility bite line may be used to perform a quality control check of the adhesive application of step 750. Step 760 may be optionally performed prior to the ultimate assembly of the shoe upper assembly and the shoe sole assembly. In step 770 the upper may be permanently attached to the shoe sole assembly. Step 770 may be performed, for example, by using adhesives applied to the shoe upper and/or shoe sole assembly to permanently affix the shoe upper to the shoe sole assembly. Step 770 may require the activation of one or more adhesives through other processes, such as heating or ultraviolet activation, and the application of pressure to force the lasted shoe upper against the shoe sole assembly with a predetermined amount of force for a predetermined amount of time, and/or adhesive curing. In step 780, the limited visibility bite line may optionally be used to perform a quality control check of the assembled shoe upper and shoe sole assembly. For example, in step 780 the assembled shoe upper and shoe sole assembly may be evaluated to assure that the edges of shoe sole assembly on shoe upper correctly correspond to the limited visibility bite line. Step 780 may be performed either by a human performing a quality control check or and optical recognition system, or some combination of both. Method 700 may conclude with step 790 of optionally rendering the limited visibility bite line unobservable. Step 790 may be particularly useful if the limited visibility bite line requires erasure or other removal to be rendered unobservable. Step 790 may occur without direct action if limited visibility bite lines are created using inks or other materials that rapidly fade or that are only observable under specific viewing conditions that are not likely to be experienced by ultimate purchasers and/or users of a shoe.

Systems and methods of generating bite lines for the assembly of shoes in accordance with the present invention are not limited to the examples illustrated and described herein. For example, a variety of arm and stylus assemblies may be used to contact a partially assembled shoe beyond the examples provided herein. Further, depending upon the mechanical operation and/or computing software employed, the desired location for a digital and/or limited visibility bite line may vary, such as by offsetting the bite line in a given direction. For example, a digital stylus tip may be offset from a marking tip by a predetermined distance, and that distance may be accounted for in the generation of a digital bite line and/or tool paths. Further, the creation of a limited visibility bite line may be performed in any fashion that creates a usable mark for quality control check purposes that will not mar or blemish a completed shoe. The limited visibility bite line may be omitted entirety if quality control checks are not necessary, if quality control checks are to be performed without the assistance of a visible bite line or if quality control checks are to be performed using an automated optical system with the digital bite line as a reference. Variables such as the amount of pressure applied to partially assemble a lasted shoe upper and a shoe sole assembly, the rate of rotating a partially assembled shoe, the frequency of recording the location of a digital stylus, and the like may be adjusted based upon the characteristics of a shoe being assembled and the equipment and materials being used for that assembly.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. Such variations are not to be regarded as a departure from the invention, and all such modifications are intended to be included within the scope of the invention.

Having thus described the invention, what is claimed is:

1. A system for generating a bite line during the assembly of a shoe, the system comprising:

a rotatable table that revolves at a known rate while retaining a shoe sole assembly with a lasted shoe upper pressed into the shoe sole assembly with a predetermined force;

a stylus that contacts the shoe upper at a junction line between the lasted shoe upper and the shoe sole assembly while the shoe upper is pressed into the shoe sole assembly with the predetermined force and while the lasted shoe upper and shoe sole assembly are rotated at the known rate; and a computing system operable to receive a plurality of measurements taken during the rotation of the shoe upper and the shoe sole assembly, the plurality of measurements corresponding to the location of the stylus in contact with the junction line at a plurality of times, and further operable to generate a digital bite line corresponding to the received plurality of measurements.

2. The system of claim 1, wherein the stylus further comprises a marking tip that contacts the shoe upper as the shoe upper and shoe sole assembly are rotated to create a visible bite line.

3. The system of claim 2, wherein the marking tip is adapted to apply a limited visibility bite line observable only under limited conditions.

4. The system of claim 1, further comprising an articulated arm assembly that generates the measurements of the location of the stylus in three dimensions and communicates those measurements to the computing system.

5. The system of claim 4, wherein the stylus further comprises a limited visibility marking tip that forms a limited visibility bite line viewable only under ultraviolet lighting conditions.

6. The system of claim 1, further comprising a press that applies a predetermined pressure to the lasted shoe upper.

7. The system of claim 6, further comprising a first member that transmits pressure from the press to the last within the shoe upper.

8. The system of claim 7, further comprising a second member that transmits pressure from the press to a top portion of the shoe upper.

9. A system for simultaneously generating a digital bite line and a limited visibility bite line for use in assembling a shoe, the system comprising:

a turntable that receives a shoe sole assembly and rotates at a known rate;

a press that applies a predetermined pressure to a lasted shoe upper to engage the lasted shoe upper with a shoe sole assembly retained upon the turntable, the press operable to apply the predetermined pressure to the lasted upper while the shoe sole assembly and lasted upper are rotated at the known rate; and a stylus assembly comprising a limited visibility marking tip that contacts the shoe upper at a junction line between the lasted shoe upper and the shoe sole assembly and a digital bite line creation unit that communicates measurements of the location of the stylus assembly at predetermined time intervals to a computing device to generate a digital bite line representative of the measurements made of the location of the stylus assembly.

10. The system of claim 9, further comprising a tool path generation component that accesses the digital bite line to create a tool path for the application of an adhesive within the area bounded by the bite line.

11. The system of claim 10, further comprising an optical recognition quality control system that verifies that adhesives applied using the tool path created by the tool path generation component do not extend beyond the limited visibility bite line.

12. The system of claim 11, wherein the tool path generation component generates a tool path for the application of adhesives to the portion of the shoe upper that will be covered by the shoe sole assembly after the construction of the shoe.

13. The garment of claim 11, wherein the tool path generation component generates a tool path for the application of adhesives to the portion of the shoe sole assembly that will be covered by the shoe upper after the construction of the shoe.

14. The system of claim 9, wherein the limited visibility marking tip applies a removable mark to the shoe upper.

15. The system of claim 9, wherein the limited visibility marking tip applies a mark observable only under specific viewing conditions.

16. A method for simultaneously generating a digital bite line and a limited visibility bite line for the assembly of a shoe, the method comprising:

pressing a lasted shoe upper into a shoe sole assembly with a predetermined pressure to form a junction line where the lasted shoe upper meets the shoe sole assembly;

rotating the lasted shoe upper and shoe sole assembly at a known rate while the lasted shoe upper is pressed into the shoe sole assembly with the predetermined pressure;

contacting a stylus with a limited visibility marking tip to the junction line while the lasted shoe upper and shoe sole assembly are rotated at the known rate, such that the limited visibility marking tip creates a visible bite line observable under pre-determined viewing conditions;

measuring the location of the stylus at predetermined time intervals while contacting the junction line during the rotation of the lasted shoe upper and shoe sole assembly;

recording the measurements of the location of the stylus at a computing device; and generating a digital bite line at the computing device, the digital bite line corresponding to the limited visibility bite line created by the limited visibility marking tip.

17. The method of claim 16, further comprising generating a tool path for the application of adhesives to the shoe upper within the limited visibility bite line, the generation of the tool path occurring at a computing device using the digital bite line.

18. The method of claim 16, further comprising generating a tool path for the application of adhesives to the shoe sole assembly, the generation of the tool path occurring at a computing device using the digital bite line.

19. The method of claim 16, further comprising performing a quality control check using the limited visibility bite line as a guide.

20. The method of claim 19, further comprising erasing the limited visibility bite line after the completion of the quality control check.

* * * * *